US007360921B1

(12) United States Patent
Greenspon

(10) Patent No.: US 7,360,921 B1
(45) Date of Patent: Apr. 22, 2008

(54) PORTABLE FLASHLIGHT ALARM CLOCK

(76) Inventor: David M. Greenspon, 13175 Woodland Pkwy., Clive, IA (US) 50325

( * ) Notice: Subject to any disclaimer, the term of this patent is extended or adjusted under 35 U.S.C. 154(b) by 0 days.

(21) Appl. No.: 11/452,518

(22) Filed: Jun. 14, 2006

(51) Int. Cl.
*F21L 14/00* (2006.01)

(52) U.S. Cl. ..... 362/205; 362/167; 362/186; 362/187

(58) Field of Classification Search ..... 362/205, 362/186, 187, 167
See application file for complete search history.

(56) References Cited

U.S. PATENT DOCUMENTS 2,763,773 A * 9/1956 Morente ..... 362/197
5,450,298 A * 9/1995 Fells et al. ..... 362/139
5,469,346 A * 11/1995 Haut et al. ..... 362/205
5,578,992 A * 11/1996 Harding ..... 340/574
6,273,582 B1 * 8/2001 Taggart et al. ..... 362/119

* cited by examiner

*Primary Examiner*—Anabel M Ton
(74) *Attorney, Agent, or Firm*—G. Brian Pingel; Camille L. Urban; Adams W. Jones

(57) ABSTRACT

A portable flashlight alarm clock apparatus includes a clock and flashlight assembly having an elongated housing with a body portion and a sleeve member. The housing includes a flashlight assembly and a clock assembly and the sleeve member is sized to receive the housing and is slidably associated therewith from a closed condition to an open condition in which a time display of the clock assembly is visible.

12 Claims, 7 Drawing Sheets

PORTABLE FLASHLIGHT ALARM CLOCK

BACKGROUND OF THE INVENTION

1. Field of the Invention

The present invention relates in general to a small, pocket size flashlight apparatus and more specifically relates to such apparatus that includes a clock assembly that is protected by a sleeve.

2. Description of the Prior Art

A variety of pocket size flashlight devices are known in the prior art to provide lighting for users temporarily as needed. The present invention is adapted to provide an improvement over such prior devices by having a clock assembly preferably with an alarm function so that a user not only is provided with a light source, but also can determine the correct time.

SUMMARY OF THE INVENTION

The present invention provides a portable flashlight alarm clock apparatus having a clock and flashlight assembly that includes a housing with a head portion and a body portion. The apparatus further includes a flashlight means and clock means contained within the housing and an elongated hollow sleeve member that is sized to receive the body portion of said housing and is slidably associated therewith so that said body portion can either be fully enclosed by said sleeve member in a closed condition or can be partially removed from said sleeve in an open condition.

The flashlight assembly is formed of a first light source located in the head portion of said housing and means for activating said first light source. The clock assembly includes an electronic clockwork with an alarm function, time display means associated with said clockwork and means for controlling said clockwork. Additionally, the clock assembly includes a second light source associated with said display means and means for activating said second light source.

The first light source and the second light source are preferably alternatively activated by a switch on the head portion of said housing so that said first light source can be activated only when said body portion is in the closed condition and said second light source can only be activated when said body portion is in said open condition.

Thus, the present invention provides a flashlight alarm clock apparatus that has the ability to alternatively provide a light source by which a user can see and a clock assembly with a lighted display to provide the user with the correct time. The foregoing and other advantages of the invention will appear from the following description when taken in conjunction with the accompanying drawings, showing by way of example, a preferred embodiment of the inventive idea wherein like numerals refer to like parts throughout.

DETAILED DESCRIPTION OF THE PREFERRED EMBODIMENT

Figure 1:
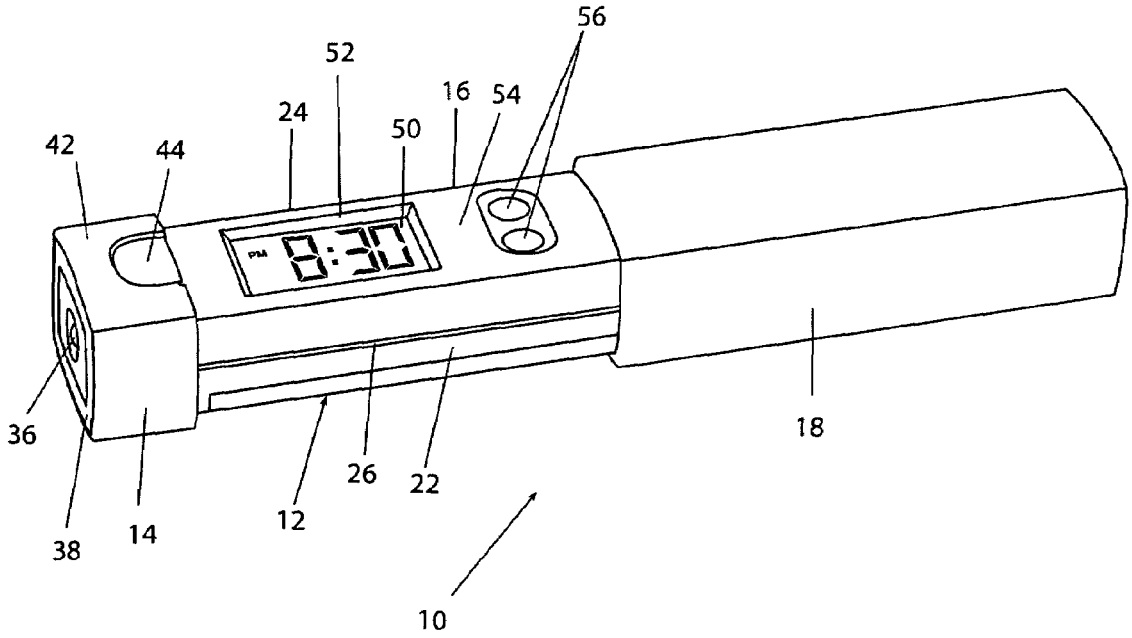
FIG. 1 is a top side perspective view of a preferred embodiment of a portable flashlight alarm clock of the present invention that is formed of an elongated housing and a sleeve member and is shown in an open condition.

Referring now to the drawings and with reference first to FIG. 1 a preferred embodiment of a portable flashlight alarm clock apparatus of the present invention is shown at 10 and is miniature in size so that it conveniently can fit into a shirt or pants pocket. The apparatus 10 is particularly well adapted to provide a temporary light source that can conveniently be carried by a user and also provide an illuminated time display and alarm clock when desired.

Figure 2:
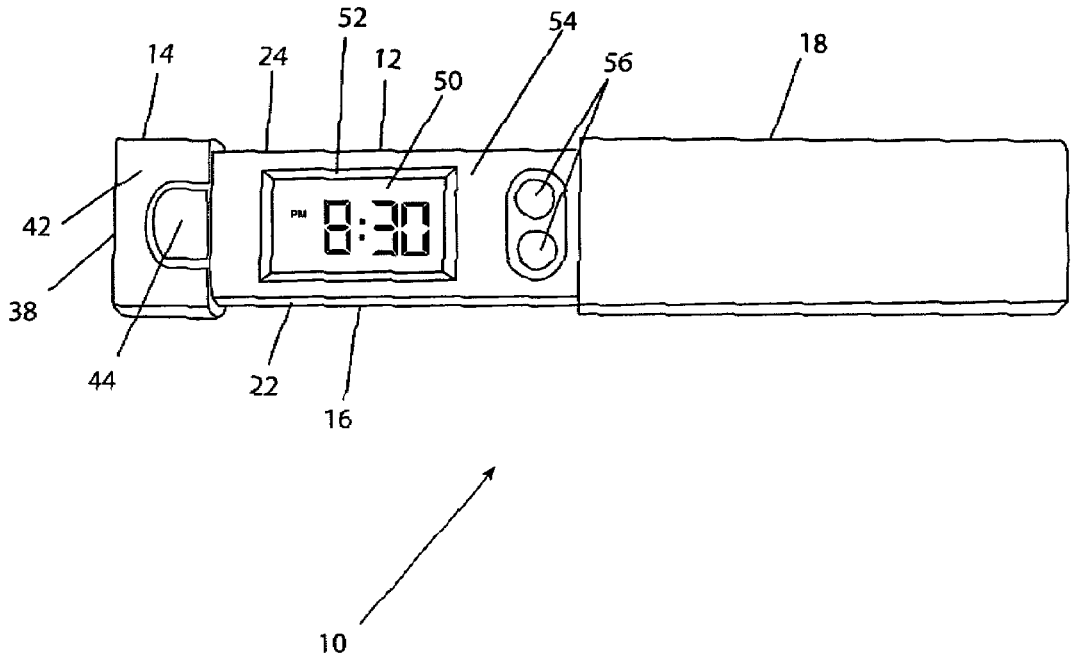
FIG. 2 is a top plan view thereof.
Figure 3:
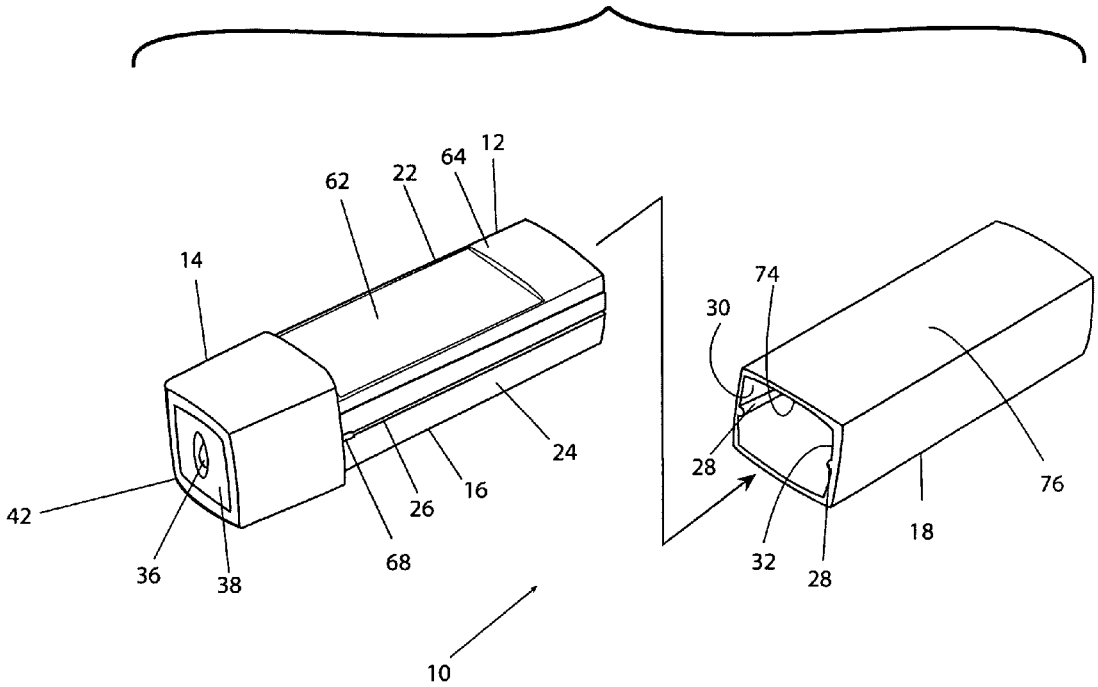
FIG. 3 is a bottom-side perspective view showing an opposite side of that shown in FIG. 1 and with the sleeve member removed from the housing to more fully illustrate the invention.
Figure 4:
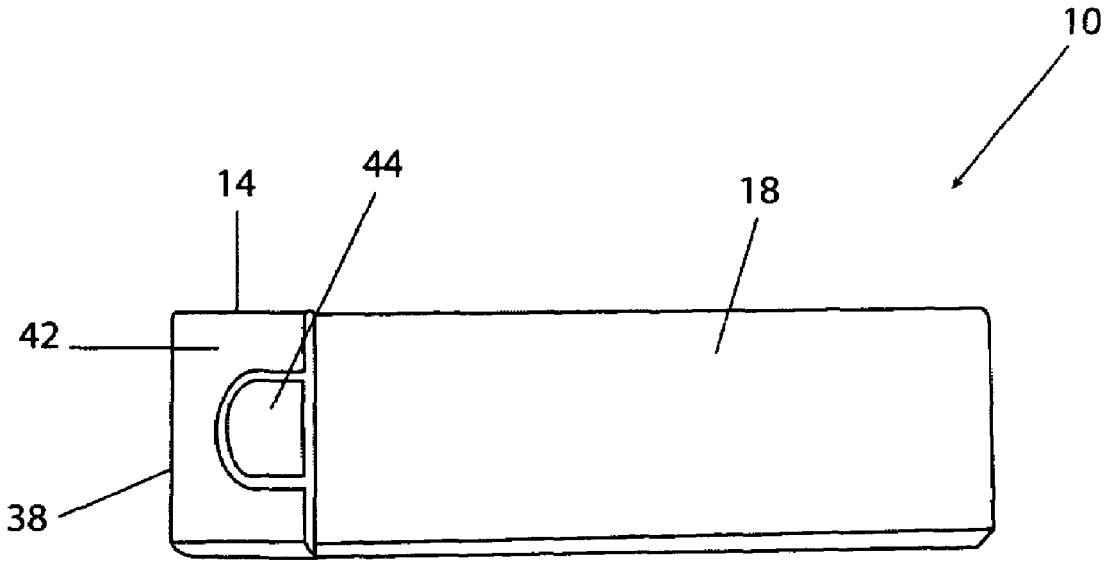
FIG. 4 is a top plan view of the embodiment of FIG. 1 but showing such embodiment in a closed condition.

Referring now to FIGS. 1-4, the apparatus 10 is formed of an elongated housing 12 having a head portion 14 and a body portion 16 and an elongated hollow sleeve member 18. The sleeve member 18 is sized to receive the body portion 16 of said housing 12 and is slidably associated therewith so that said body portion 12 can either be fully enclosed by the sleeve member 18, as shown in FIG. 4 in a closed condition, or can be partially removed therefrom, as shown in FIGS. 1 and 2 in an open condition. For orientation purposes, the body portion 16 has opposite sidewalls 22 (FIG. 1) and 24 (FIG. 3) that include narrow longitudinally aligned channels 26 that receive elongated guide ribs 28 (shown only in FIG. 3) longitudinally aligned in opposite interior sidewalls 30 and 32 of the sleeve member 18.

The housing 12 includes a flashlight means, a clock means with an alarm function and a mirror. The flashlight means is formed of a first light source 36 that is contained in an outer end 38 of the head portion 14 and at least one battery 40, shown only in FIG. 7, that is contained in the housing body portion 16. A top side 42 of the head portion 14 includes a push button 44 that can be pressed down to activate a switch 46 (FIG. 7) to energize the light source 36.

Figure 5:
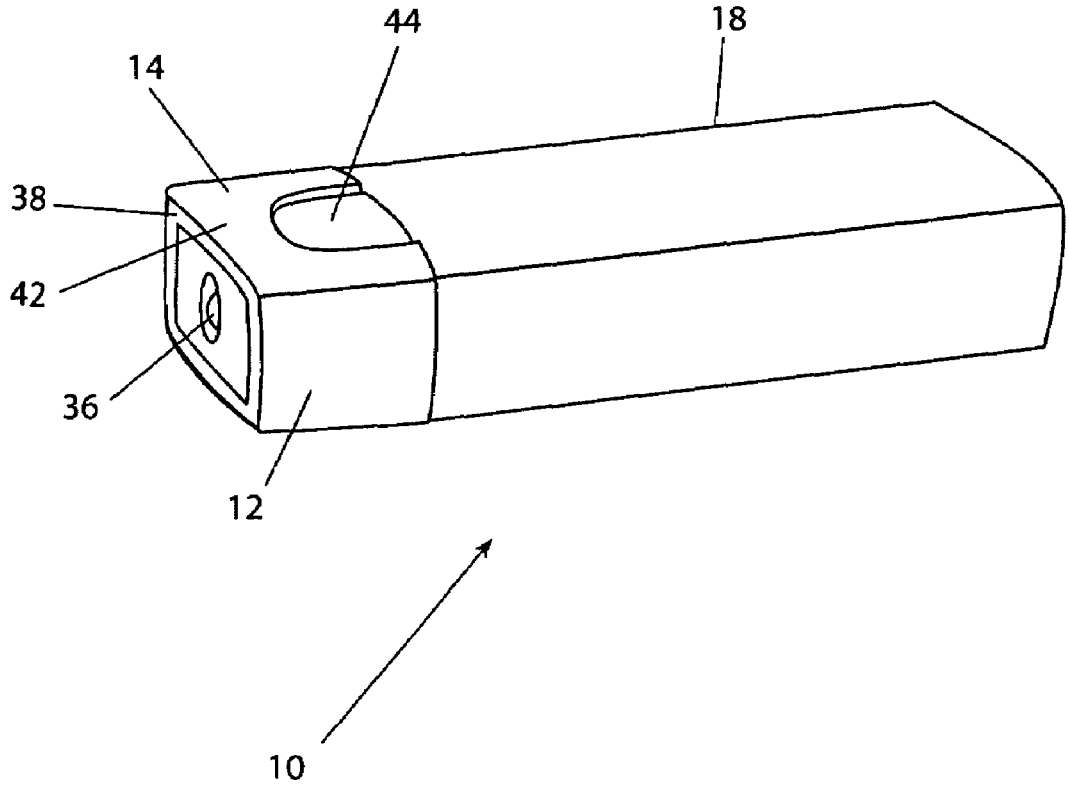
FIG. 5 is a top side perspective view thereof in a closed condition.
Figure 6:
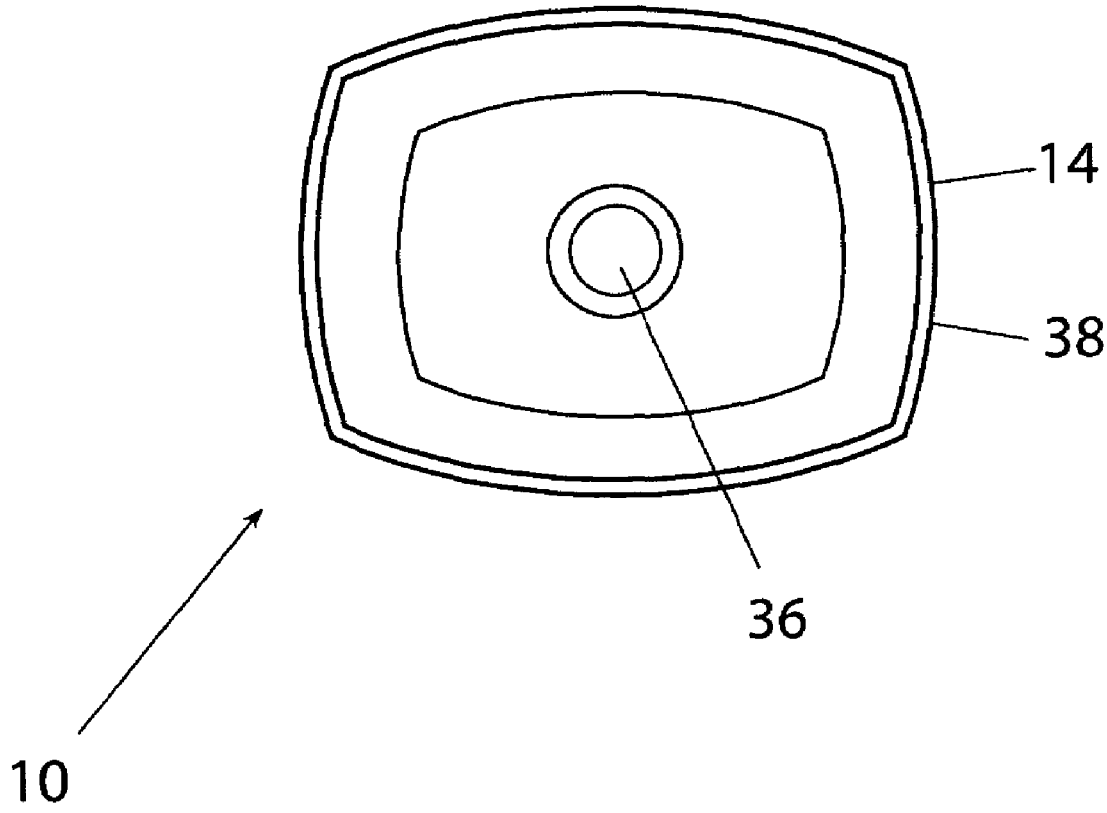
FIG. 6 is an enlarged front view in elevation.

The clock means is contained in the housing body portion 16 and includes a clock-work 48 (FIG. 7) and a time display 50 that is associated with an opening 52 in a sidewall 54 of the body portion 16. The clockwork 48 is adjustable by means of control buttons 56 located on the sidewall 54 to set it with the correct time or to utilize the alarm function. As should readily be recognized from the above description, when the apparatus 10 is in a closed condition, such as shown in FIGS. 4 and 5, the time display 50 is covered and protected by the sleeve member 18. Correspondingly, when the apparatus 10 is in the open condition, the time display 50 is clearly visible.

Referring now to FIG. 3, in accordance with the convenience objectives that are provided by the present invention, the apparatus 10 also includes a mirror 62 that is secured on a sidewall 64 of the body portion 16 that is preferably opposite to that of the sidewall 54. Thus, the sleeve member 18 shields and protects the mirror 62 when the apparatus 10 is in the closed condition.

Figure 7:
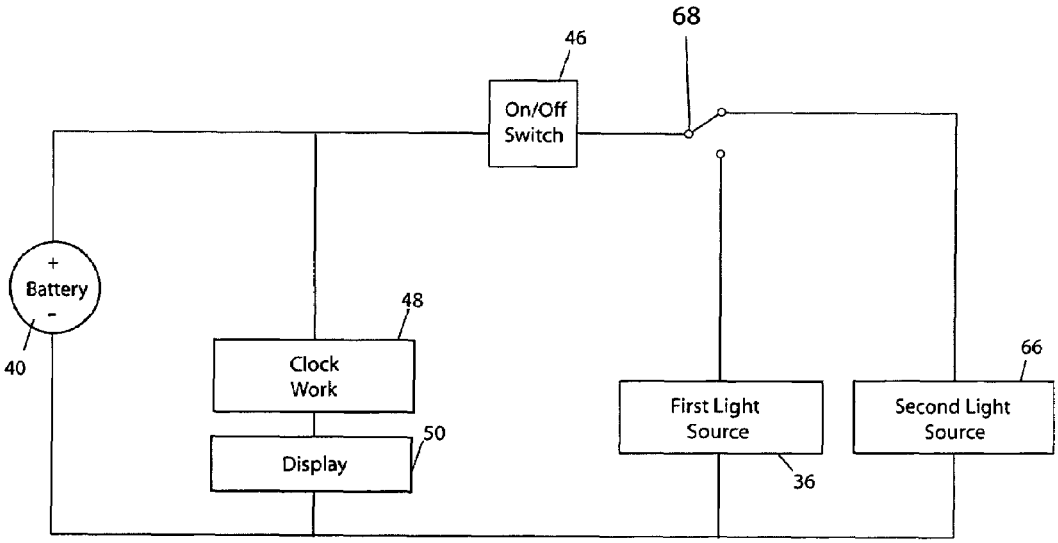
FIG. 7 is a block diagram showing the electronic circuitry thereof.

Preferably, the time display 50 is associated with a second light source 66 (see FIG. 7) that can also be actuated by the push button 44 so that the display 50 can be conveniently seen in a dark environment. However, in most cases when a user desires to see the time display 50, it is inconvenient to also have the flashlight means of the apparatus 10 activated. Accordingly, as indicated by FIG. 7, the circuitry of the apparatus 10 is designed so that the light sources 36 and 66 cannot be energized at the same time. Instead, light source 36 can only be activated when the apparatus 10 is in the closed condition and the light source 66 can only be activated when the apparatus 10 is in an open condition.

This alternative operation of the light sources 36 and 66 is provided through the use of a 2-way changeover electrical switch 68 that directs electrical power to either the first light source 36 or the second light source 66. The switch 68 is spring biased and is located in one of the channels 26, as indicated in FIGS. 1 and 3 where such channel 26 joins the head portion 14. The elongated guide ribs 28 are fashioned at one end to protrude such that when the sleeve member 18 is in the closed position the guide rib 28 associated with such channels 26 depresses the 2-way changeover electrical switch 68 and directs power to the first light source 36. When the sleeve member 18 is in the open position, the protruding end of the associated guide rib 28 releases the switch 68 and routes the power to the second light source 66. Thus, when the push button 44 is pressed down with the sleeve member 18 in the closed position the first light source 36 is activated. Alternatively, when the push button 44 is pressed down with the sleeve member 18 in the open position the second light source 66 is activated. By this alternative illumination of the light sources 36 and 66, the life of the battery 40 can be extended.

Thus, the present invention has been designed to serve as a convenient means for providing emergency lighting and the convenience of a time display and a mirror for a user as desired. Although the invention has been described with respect to a preferred embodiment thereof, it is to be understood that it is not to be so limited, since changes and modifications can be made therein which are within the fully intended scope of the invention as defined by the appended claims.

What is claimed is:

1. A portable flashlight alarm clock apparatus comprising:

(A) a clock and flashlight assembly having:

(1) an elongated housing having a head portion and a body portion;

(2) flashlight means contained in said housing including:

(a) a first light source located in the head portion of said housing;

(b) means for activating said first light source;

(3) clock means contained in said housing body portion including:

(a) an electronic clockwork;

(b) time display means associated with said housing body portion;

(c) means for controlling said clockwork;

(4) a battery power source; and (B) an elongated hollow sleeve member that is sized to receive the body portion of said housing and is slidably associated therewith so that said body portion and said time display means can either be fully enclosed by said sleeve member in a closed condition or can be partially removed from said sleeve in an open condition in which said time display means can be viewed.

2. The portable flashlight alarm clock as described in claim 1, wherein said clock means further include a second light source associated with said display means and means for activating said second light source.

3. The portable flashlight alarm clock apparatus as described in claim 2, wherein said housing head portion includes a switch for alternatively controlling said means for activating said first light source and said means for activating said second light source.

4. The portable flashlight alarm clock apparatus as described in claim 3, wherein said first light source can only be actuated when said housing is in the closed condition and said means for activating said second light source can only be activated when said housing is in the open condition.

5. The portable flashlight alarm clock apparatus as described in claim 4, wherein a mirror is associated with said body.

6. A portable flashlight alarm clock apparatus comprising:

(A) a clock and flashlight assembly having:

(1) an elongated housing having a head portion and a body portion with an opening in one side;

(2) flashlight means contained in said housing including:

(a) a first light source located in the head portion of said housing;

(b) means for activating said first light source;

(3) clock means contained in said housing including:

(a) an electronic clockwork;

(b) time display means associated with said clockwork and said housing side opening;

(c) means for controlling said clockwork;

(d) a second light source associated with said display means;

(e) means for activating said second light source;

(4) a battery power source;

(B) an elongated hollow sleeve member that is sized to receive the body portion of said housing and is slidably associated therewith so that said body portion can either be fully enclosed by said sleeve member in a closed condition or can be partially removed from said sleeve in an open condition in which said time display means can be viewed; and (C) said first light source can only be activated when said housing is in the closed condition and said second light source can only be activated when said housing is in the open condition.

7. The portable flashlight alarm clock apparatus as described in claim 6, wherein a switch means is associated with said housing head portion and it is adapted to alternatively activate said first light source and said second light source.

8. The portable flashlight alarm clock apparatus as described in claim 7, wherein a mirror is secured on said body and said clock means includes an alarm function.

9. A portable flashlight alarm clock apparatus comprising:

(A) a clock and flashlight assembly having:

(1) an elongated housing having a head portion and a body portion;

(2) flashlight means contained in said housing including:

(a) a first light source located in the head portion of said housing;

(b) means for activating said first light source;

(3) clock means contained in said housing body portion including:

(a) an electronic clockwork;

(b) time display means associated with said housing body portion;

(c) means for controlling said clockwork;

(4) a battery power source; and (B) an elongated hollow sleeve member that is sized to receive the body portion of said housing and is slidably associated therewith so that said body portion and said time display means can either be fully enclosed by said sleeve member in a closed condition or can be partially removed from said sleeve in an open condition in which said time display means can be viewed; and (C) said first light source can only be actuated when said housing is in the closed condition and said means for activating said second light source can only be activated when said housing is in the open condition.

10. The portable flashlight alarm clock as described in claim 9, wherein said clock means further include a second light source associated with said display means and means for activating said second light source.

11. The portable flashlight alarm clock apparatus as described in claim 10, wherein said housing head portion includes a switch for alternatively controlling said means for activating said first light source and said means for activating said second light source.

12. The portable flashlight alarm clock apparatus as described in claim 11, wherein a mirror is associated with said body.

* * * * *